US008686936B2

(12) United States Patent
Lee et al.

(10) Patent No.: US 8,686,936 B2
(45) Date of Patent: Apr. 1, 2014

(54) LIQUID CRYSTAL DISPLAY APPARATUS AND METHOD OF DRIVING THE SAME

(75) Inventors: Seung-Kyu Lee, Yongin (KR); Kyung-Hoon Kim, Yongin (KR); Chul-Ho Kim, Yongin (KR); Dong-Hoon Lee, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 348 days.

(21) Appl. No.: 13/042,621

(22) Filed: Mar. 8, 2011

(65) Prior Publication Data

US 2011/0279431 A1 Nov. 17, 2011

(30) Foreign Application Priority Data

May 17, 2010 (KR) ..... 10-2010-0046031

(51) Int. Cl.
*G09G 3/36* (2006.01)

(52) U.S. Cl.
USPC ..... 345/96

(58) Field of Classification Search
USPC ..... 345/84–104
See application file for complete search history.

(56) References Cited

U.S. PATENT DOCUMENTS

| | | | | |
|---|---|---|---|---|
| 5,233,338 | A * | 8/1993 | Surguy | 345/88 |
| 6,392,620 | B1 * | 5/2002 | Mizutani et al. | 345/88 |
| 7,068,330 | B2 * | 6/2006 | Song et al. | 349/39 |
| 7,138,993 | B2 * | 11/2006 | Herrmann | 345/211 |
| 7,663,583 | B2 * | 2/2010 | Lee et al. | 345/87 |
| 7,825,885 | B2 * | 11/2010 | Sato et al. | 345/89 |
| 2002/0084969 | A1 * | 7/2002 | Ozawa | 345/96 |
| 2002/0084970 | A1 * | 7/2002 | Ozawa | 345/96 |
| 2007/0229447 | A1 * | 10/2007 | Takahara et al. | 345/102 |

FOREIGN PATENT DOCUMENTS

| | | | |
|---|---|---|---|
| JP | 2003-150080 | A | 5/2003 |
| JP | 2008-170942 | | 7/2008 |
| KR | 10-2004-0037903 | A | 5/2004 |
| KR | 10-2005-0029813 | | 3/2005 |
| WO | 00/58777 | | 10/2000 |
| WO | 02/061931 | | 8/2002 |

OTHER PUBLICATIONS

Korean Office action issued by Korean Industrial Property Office on Aug. 3, 2011, corresponding to KR 10-2010-0046031 and Request for Entry attached herewith.

* cited by examiner

*Primary Examiner* — Bipin Shalwala
*Assistant Examiner* — Steven Holton
(74) *Attorney, Agent, or Firm* — Robert E. Bushnell, Esq.

(57) ABSTRACT

A liquid crystal display apparatus and a method of driving the liquid crystal display apparatus, which commonly boosts pixels of a first group and commonly boosts pixels of a second group. The liquid crystal display apparatus includes a first group of pixels for displaying an image and a second group of pixels for displaying an image. Each pixel of the first and second groups includes a storage capacitor for storing a data voltage. The liquid crystal display apparatus further includes a first storage common voltage line connected to storage capacitors of the pixels of the first group of pixels, a second storage common voltage line connected to storage capacitors of the pixels of the second group of pixels. A first storage common voltage is supplied to the pixels of the first group through the first storage common voltage line, and a second storage common voltage is supplied to the pixels of the second group through the second storage common voltage line.

16 Claims, 5 Drawing Sheets

LIQUID CRYSTAL DISPLAY APPARATUS AND METHOD OF DRIVING THE SAME

CLAIM OF PRIORITY

This application makes reference to, incorporates the same herein, and claims all benefits accruing under 35 U.S.C. §119 from an application earlier filed in the Korean Intellectual Property Office on 17 May 2010 and there duly assigned Serial No. 10-2010-0046031.

BACKGROUND OF THE INVENTION

1. Field of the Invention

Embodiments of the present invention relate to a liquid crystal display apparatus and a method of driving the liquid crystal display apparatus.

2. Description of the Related Art

A liquid crystal display apparatus displays images corresponding to input data by converting the input data into a data voltage with a data driving unit, and controlling a scanning operation of each pixel with a gate driving unit to adjust the brightness of each pixel. Each of the pixels in the liquid crystal display apparatus includes a liquid crystal capacitor that is coupled to a gate line and charged with data voltage, and a storage capacitor that is coupled to the liquid crystal capacitor to store the voltage charged in the liquid crystal capacitor. The image is displayed according to the voltage charged in the liquid crystal capacitor.

SUMMARY OF THE INVENTION

The present invention provides a method of time-divisionally driving a liquid crystal display apparatus.

The present invention also provides a liquid crystal display apparatus that is time-divisionally driven to improve a charging speed and brightness thereof.

According to an aspect of the present invention, there is provided a liquid crystal display apparatus including a first group of pixels for displaying an image and a second group of pixels for displaying an image. Each pixel in the first and second groups is disposed on a portion where one of data lines and one of gate lines cross each other. Each pixel of the first and second groups includes a storage capacitor for storing a data voltage. The liquid crystal display apparatus further includes a gate driving unit for outputting scan pulses to the pixels of the first and second groups through the gate lines, a data driving unit for generating a data voltage corresponding to an input image data signal and outputting the data voltage to each pixel of the first and second groups through the data lines, a first storage common voltage line connected to the storage capacitors of the pixels of the first group of pixels, a second storage common voltage line connected to the storage capacitors of the pixels of the second group of pixels, and a storage common voltage driving unit for generating a first storage common voltage and outputting the first storage common voltage to the pixels of the first group through the first storage common voltage line. The storage common voltage driving unit generates a second storage common voltage and outputting the second storage common voltage to the pixels of the second group through the second storage common voltage line.

The liquid crystal display apparatus may further include a backlight unit for emitting light to the pixels of the first and second groups.

In a first programming section, the first storage common voltage may have a storage common high voltage level and the second storage common voltage may have a storage common low voltage level. In a first light emitting section, the first storage common voltage may have the storage common low voltage level and the second storage common voltage may have the storage common high level. The backlight unit may emit light during the first light emitting section. The data voltage may be stored in the storage capacitor of the each pixel of the first and second groups during the first programming section. The first light emitting section may sequentially follow the first programming section.

In a second programming section, the first storage common voltage may have the storage common low voltage level and the second storage common voltage may have the storage common high level. In a second light emitting section, the first storage common voltage may have the storage common high voltage level and the second storage common voltage may have the storage common low voltage level. The backlight unit may emit light during the second light emitting section. The data voltage may be stored in the storage capacitor of the each pixel of the first and second groups during the second programming section. The second light emitting section may sequentially follow the second programming section.

The data driving unit may write the data voltage in the pixels of the first group in a negative direction from the storage common high voltage level during the first programming section, and may write the data voltage in the pixels of the second group in a positive direction from the storage common low voltage level during the first programming section. The data driving unit may write the data voltage in the pixels of the first group in the positive direction from the storage common low voltage level during the second programming section, and may write the data voltage in the pixels of the second group in the negative direction from the storage common high voltage level during the second programming section.

The data driving unit may supply the data voltage so as to have a red (R) sub-frame section in which the data voltage with respect to R is generated and output, a green (G) sub-frame section in which the data voltage with respect to G is generated and output, and a blue (B) sub-frame section in which the data voltage with respect to B is generated and output, in a time-divisional method.

The pixels of the first group may be located on odd-numbered lines, and the pixels of the second group may be located on even-numbered lines.

According to another aspect of the present invention, there is provided a method of driving a liquid crystal display apparatus, which includes a first group of pixels for displaying an image and a second group of pixels for displaying an image, a first storage common voltage line connected to storage capacitors of the pixels of the first group of pixels, and a second storage common voltage line connected to storage capacitors of the pixels of the second group of pixels. The method includes writing a data voltage in the pixels of the first and second groups, supplying a first storage common voltage to the pixels of the first group through the first storage common voltage line, supplying a second storage common voltage to the pixels of the second group through the second storage common voltage line, transiting the voltage levels of the first and second storage common voltages, and emitting light from a backlight unit included in the liquid crystal display apparatus.

The method may further include: performing programming, transiting, and light emitting for R pixels, performing programming, transiting, and light emitting for G pixels; and performing programming, transiting, and light emitting for B pixels.

The method may further include writing the data voltage in the pixels of the first group in a negative direction from the storage common high voltage level during the first programming section, writing the data voltage in the pixels of the second group in a positive direction from the storage common low voltage level during the first programming section, writing the data voltage in the pixels of the first group in the positive direction from the storage common low voltage level during the second programming section, and writing the data voltage in the pixels of the second group in the negative direction from the storage common high voltage level during the second programming section.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
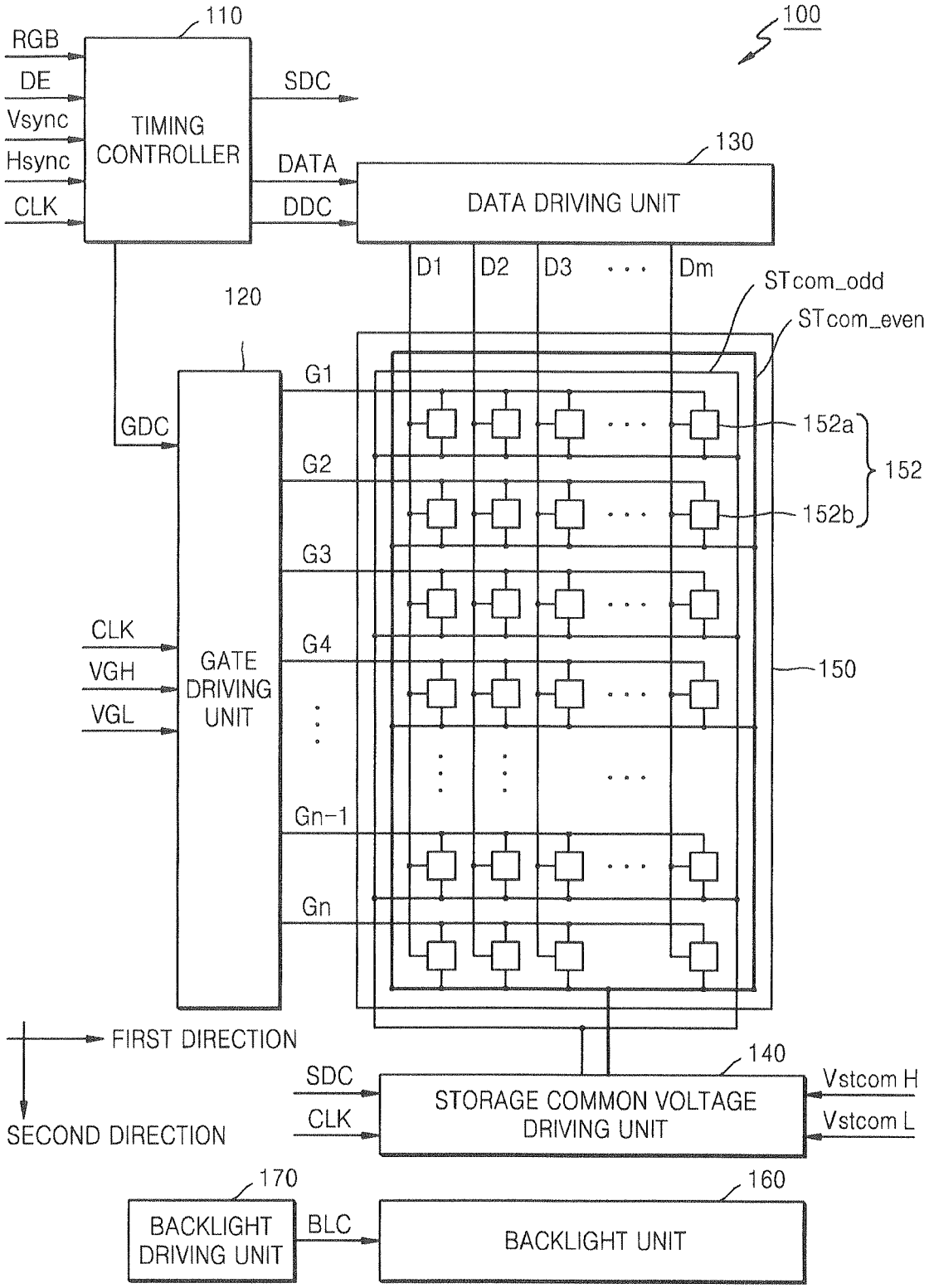
FIG. 1 is a block diagram of a liquid crystal display apparatus according to an embodiment of the present invention.

A liquid crystal display apparatus displays images corresponding to input data by converting the input data into a data voltage with a data driving unit, and controlling a scanning operation of each pixel with a gate driving unit to adjust the brightness of each pixel. Each of the pixels in the liquid crystal display apparatus includes a liquid crystal capacitor that is coupled to a gate line and charged with data voltage, and a storage capacitor that is coupled to the liquid crystal capacitor to store the voltage charged in the liquid crystal capacitor. The image is displayed according to the voltage charged in the liquid crystal capacitor.

The present invention will now be described more fully with reference to the accompanying drawings, in which exemplary embodiments of the invention are shown. In the description of the present invention, if it is determined that a detailed description of commonly-used technologies or structures related to the invention may unnecessarily obscure the subject matter of the invention, the detailed description will be omitted. Also, since later-described terms are defined in consideration of the functions of the present invention, they may vary according to users' intentions or practice. Hence, the terms must be interpreted based on the contents of the entire specification.

It will be understood that when an element or layer is referred to as being "connected to" or "coupled to" another element, the element or layer can be directly connected or coupled to another element or intervening elements.

In contrast, when an element is referred to as being "directly connected to" or "directly coupled to" another element, there are no intervening elements present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be described with reference to accompanying drawings.

FIG. 1 is a block diagram of a liquid crystal display apparatus 100 according to an embodiment of the present invention.

The liquid crystal display apparatus 100 of the present embodiment includes a timing controller 110, a gate driving unit 120, a data driving unit 130, a storage common voltage driving unit 140, and a pixel unit 150.

The timing controller 110 receives input image signals RGB (signals for R, G, and B pixels), a data enable signal DE, a vertical synchronization signal Vsync, a horizontal synchronization signal Hsync, and a clock signal CLK from an external graphic controller (not shown). Herein the symbols R, G and B mean red, green and blue color pixels, respectively. The timing controller 110 generates an image data signal DATA, a data driving control signal DDC, a gate driving control signal GDC, and a storage common voltage driving control signal SDC. The timing controller 110 receives input control signals such as the horizontal synchronization signal Hsync, the clock signal CLK and the data enable signal DE, and outputs the data driving control signal DDC. The data driving control signal DDC is a signal for controlling operations of the data driving unit 130, and includes a source shift clock SSC, a source start pulse SSP, a polarity control signal POL, and a source output enable signal SOE as signals for controlling operations of the data driving unit 130. In addition, the timing controller 110 receives the vertical synchronization signal Vsync and the clock signal CLK, and outputs the gate driving control signal GDC. The gate driving control signal GDC is a signal for controlling operations of the gate driving unit 120, and includes a gate start pulse GSP and a gate output enable signal GOE. The storage common voltage driving control signal SDC is a signal for controlling operations of the storage common voltage driving unit 140. In FIG. 1, the storage common voltage driving control signal SDC and the clock signal CLK applied to the storage common voltage driving unit 140 are supplied from the timing controller 110.

The gate driving unit 120 sequentially generates scan pulses (that is, gate pulses) corresponding to the gate driving control signal GDC supplied from the timing controller 110, and supplies the generated scan pulses to gate lines G1 through Gn. Here, the gate driving unit 120 determines a voltage level of a scan pulse according to a gate high voltage VGH and a gate low voltage VGL, which are supplied from an external circuit. The voltage level of the scan pulse may vary depending on a kind of a switching device M1 formed in a pixel 152 (see FIG. 2). That is, if the switching device M1 is an n-type transistor, the scan pulse has the gate high voltage VGH during activation, and if the switching device M1 is a p-type transistor, the scan pulse has the gate low voltage VGL during activation.

The data driving unit 130 supplies data voltages to data lines D1 through Dm corresponding to the image data signal DATA and the data driving control signal DDC supplied from the timing controller 110. In more detail, the data driving unit 130 samples and latches the image data signal DATA supplied from the timing controller 110, and converts the image data signal DATA into an analog data voltage that may represent gray scale in pixels 152 of the pixel unit 150 based on a gamma reference voltage supplied from a gamma reference voltage circuit (not shown).

The pixel unit 150 includes the pixels 152 located on portions where the data lines D1 through Dm and the gate lines G1 through Gn cross each other. Each of the pixels 152 is connected to at least one data line Di, at least one gate line Gj, and a first or second storage common voltage line $ST_{com_odd}$ or $ST_{com_even}$. The gate lines G1 through Gn are extended in a first direction in parallel with each other, and the data lines D1 through Dm are extended in a second direction in parallel with each other. Alternatively, the gate lines G1 through Gn may be extended in the second direction, and the data lines D1 through Dm may be extended in the first direction. The pixels 152 of the pixel unit 150 are grouped in a first group and a second group. The pixels 152*a* of the first group are connected to the first storage common voltage lines $ST_{com_odd}$, and the pixels 152*b* of the second group are connected to the second storage common voltage lines $ST_{com_even}$. According to the present embodiment of the present invention shown in FIG. 1, the pixels 152*a* of the first group are arranged in odd-numbered rows, and the pixels 152*b* of the second group are arranged in even-numbered rows. The pixels 152 of the first and second groups may be defined variously according to embodiments. In other words, pixels 152*a* of the first group may be arranged in odd-numbered columns, and the pixels 152*b* of the second group may be arranged in even-numbered columns. The row or column is referred to as a line. A structure of the pixel 152 will be described in more detail with reference to FIG. 2.

The storage common voltage driving unit 140 receives the storage common voltage driving control signal SDC and the clock signal CLK from the timing controller 110, and receives a storage common high voltage $V_{stcom}H$, and a storage common low voltage $V_{stcom}L$ from an external circuit. The storage common voltage driving unit 140 generates a first storage common voltage $V_{stcom_odd}$ and a second storage common voltage $V_{stcom_even}$ and outputs the generated first and second storage common voltages $V_{stcom_odd}$ and $V_{stcom_even}$ to the first and second storage common voltage lines $ST_{com_odd}$ and $ST_{com_even}$, respectively. Operations of the storage common voltage driving unit 140 will be described in more detail later.

A backlight unit 160 is disposed on a rear surface of the pixel unit 150. The backlight unit 160 emits light upon receiving a backlight driving signal BLC from a backlight driving unit 170, and emits light towards the pixels 152 in the pixel unit 150. The backlight driving unit 170 generates the backlight driving signal BLC by the control of the timing controller 110 and outputs the generated backlight driving signal BLC to the backlight unit 160 in order to control light emission of the backlight unit 160.

Figure 2:
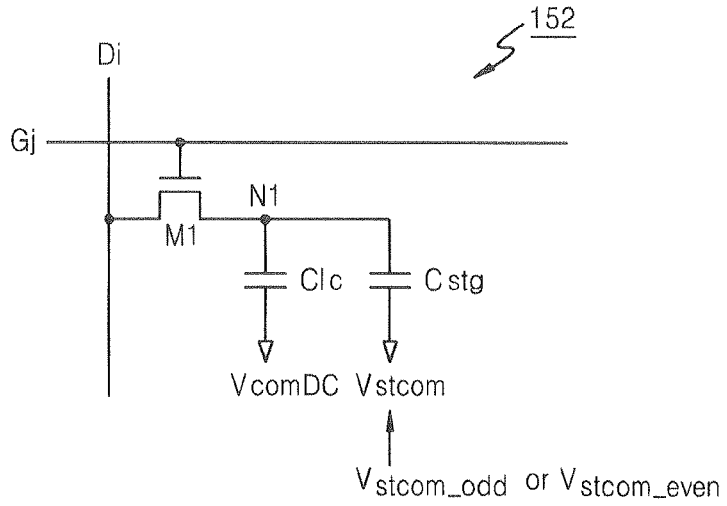
FIG. 2 is a diagram showing a circuit of a pixel according to an embodiment of the present invention.

FIG. 2 is a diagram showing a circuit of the pixel 152 according to an embodiment of the present invention.

The pixel 152 of the current embodiment includes a switching device M1, a liquid crystal capacitor $Cl_c$, and a storage capacitor $C_{stg}$. The pixel unit 150 includes an upper substrate and a lower substrate, and a common electrode is formed on the upper substrate and a pixel electrode is formed on the lower substrate. A liquid crystal layer is disposed between the upper and lower substrates. The pixel 152 is a unit portion of the pixel unit 150 to display an image The liquid crystal capacitor $Cl_c$ represents the unit portion including upper and lower substrates (in particular, a common electrode and a pixel electrode formed on the upper and lower substrates) of a liquid crystal display panel and a liquid crystal layer disposed between the upper and lower substrates. The switching device M1 includes a gate electrode that is connected to the gate line Gj, a first electrode connected to the data line Di, and a second electrode connected to a first node N1. The switching device M1 may be formed of a thin film transistor (TFT). The first node N1 is a node that is electrically equivalent with the pixel electrode PE. The liquid crystal capacitor $Cl_c$ is connected between the first node N1 and a common voltage $V_{comDC}$. The common voltage $V_{comDC}$ may be applied via the common electrode. The liquid crystal capacitor $Cl_c$ equivalently represents the pixel electrode, the common electrode, and the liquid crystal layer disposed between the pixel electrode and the common electrode. The storage capacitor $C_{stg}$ is connected between the first node N1 and the first or second storage common voltage lines $ST_{com_odd}$ or $ST_{com_even}$, through which the storage common voltage $V_{stcom}$, is applied. The storage common voltage $V_{stcom}$ is the first storage common voltage $V_{stcom_odd}$ when the pixel 152 is a pixel of the first group, and is the second storage common voltage $V_{stcom_even}$ when the pixel 152 is a pixel of the second group.

When the scan pulse is input through the gate line Gj, the switching device M1 is turned on, and the data voltage supplied through the data line Di is applied to the first node N1. Thus, a voltage level corresponding to the data voltage is stored in the storage capacitor $C_{stg}$ according to the data voltage. Orientation of the liquid crystal layer is changed by the voltage at the first node N1, and thus, light transmittance of the liquid crystal layer is changed.

Figure 3:
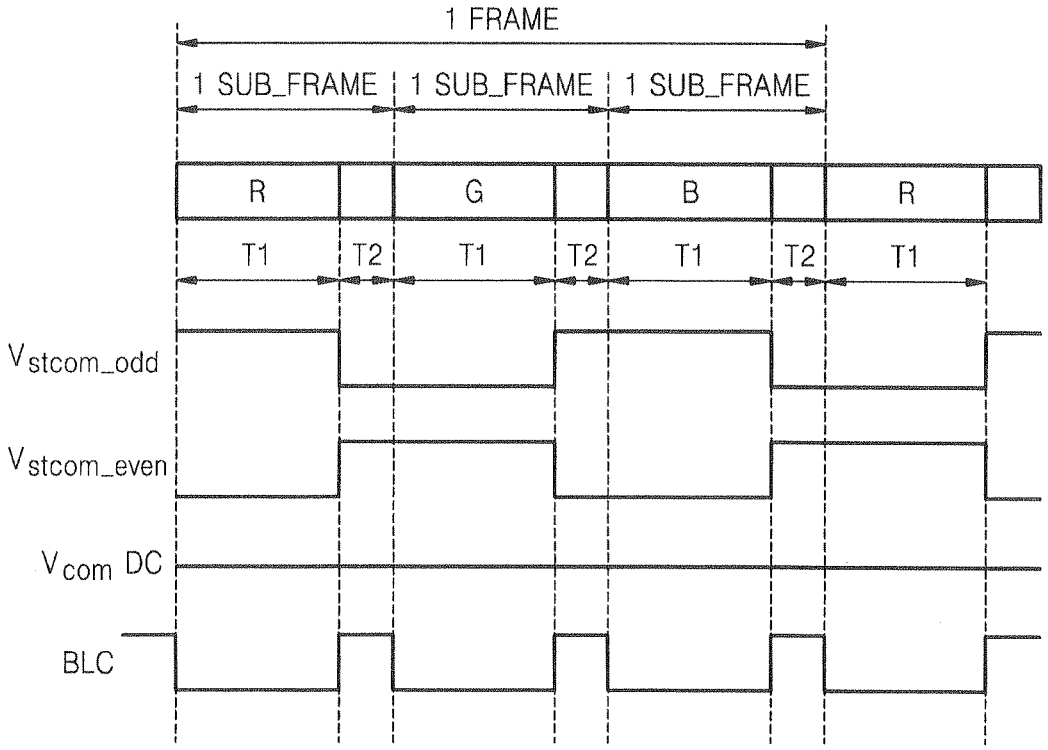
FIG. 3 is a timing diagram showing a driving timing of the liquid crystal display apparatus according to an embodiment of the present invention.

FIG. 3 is a timing diagram showing driving timings of the liquid crystal display apparatus 100, according to an embodiment of the present invention.

According to embodiments of the present invention, the liquid crystal display apparatus is driven in a field sequential color (FSC) method, that is, programming sections and light emitting sections are separated based on time. In addition, a programming and a light emission with respect to each of the red (R), green (G), and blue (B) pixels are also realized in the time-divisional way. Referring to FIG. 3, a programming section T1 and a light emitting section T2 in each of the R, G, and B pixels are realized in the time-divisional way, and a sub-frame SUB_FRAME for each of the R, G, and B colors is also realized in the time-divisional way. One frame includes sub-frames SUB_FRAME with respect to each of the R, G, and B colors. During the programming section T1, the data voltage is written (or stored) in the storage capacitor $C_{stg}$ of each of the pixels 152, and during the light emitting section T2, the level of the storage common voltage $V_{stcom}$ of all of the pixels 152 is transited so that the voltages of pixel electrodes PE (or node N1) in all of the pixels 152 are boosted, and the backlight unit 160 emits light to display images.

Figure 4:
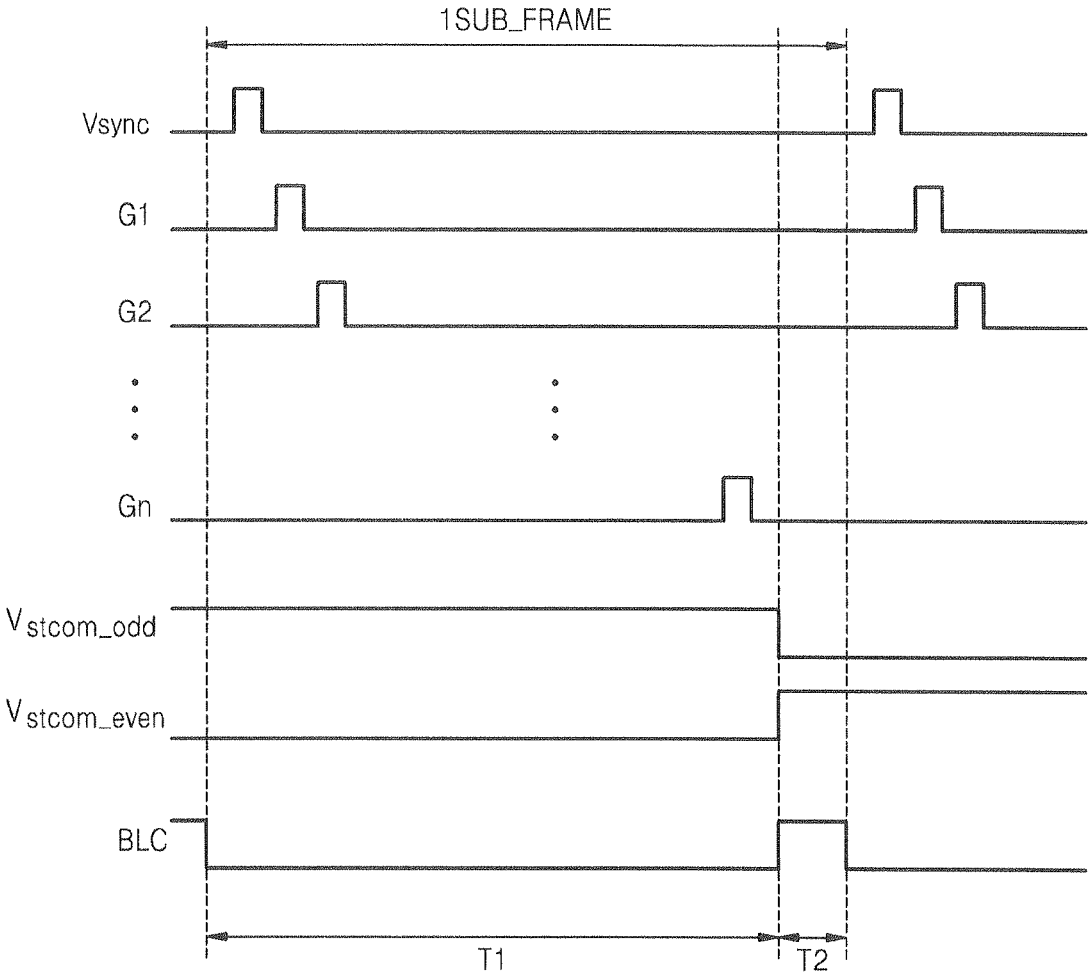
FIG. 4 is a timing diagram of driving signals with respect to one sub-frame according to an embodiment of the present invention.

Herein, the meaning of transited voltage is that the voltage level is switched from one level to another level. As shown in FIGS. 3 and 4, the first storage common voltage $V_{stcom_odd}$ is at a higher level in the first programming section T1 (T1 of R), and then switched to a lower level in the first light emitting section T2 (T2 of R) and is maintained at the lower level in the second programming section T1(T1 of G). The first storage common voltage $V_{stcom_odd}$ is switched to a higher level in the second light emitting section 12 (T2 of G). With the same principle, the second storage common voltage $V_{stcom_even}$ is at a lower level in the first programming section T1 (T1 of R), and is then switched to a higher level in the first light emitting section T2 (T2 of R) and is maintained at the higher level in the second programming section T1 (T1 of G). The second storage common voltage $V_{stcom_even}$ is switched to a lower level in the second light emitting section T2 (T2 of G). As shown in FIGS. 3 and 4, the first light emitting section T2 (T2 of R) sequentially follows the first programming section T1 (T1 of R), and the second programming section T1 (T1 of G) sequentially follows the first light emitting section T2 (T2 of R). The second light emitting section T2 (T2 of G) sequentially follows the second programming section T1 (T1 of G). In each of the sub-frames SUB_FRAME, the light emitting section T2 sequentially follows the programming section T1. The light emitting section T2 may begin right after the programming section T1, or there may a gap (time interval) between the programming section T1 and the light emitting section T2. In other words, even though FIG. 3 shows the light emitting section T2 right after the programming section T1, there may be a gap (time interval) between the light emitting section T2 and the programming section T1.

According to the present embodiment of the present invention, the storage capacitors $C_{stg}$ of the pixels 152 in the first group are connected to the first storage common voltage $V_{stcom_odd}$ and the storage capacitors $C_{stg}$ of the pixels 152 in the second group are connected to the second storage common voltage $V_{stcom_even}$, and then, all of the pixels 152 are simultaneously boosted when the programming of the sub-frames is finished. When the pixels 152 of the first group are located on odd-numbered lines and the pixels 152 of the second group are located on even-numbered lines, a line inversion driving may be performed in a simple way. According to the current embodiment, the first and second storage common voltages $V_{stcom_odd}$ and $V_{stcom_even}$ are switched between the storage common high voltage $V_{stcom}H$ and the storage common low voltage $V_{stcom}L$, and have different voltage levels from each other, which are transited whenever the programming section T1 is ended.

The liquid crystal capacitor $Cl_c$ is connected to the common voltage $V_{comDC}$ which has a direct current (DC) voltage level as shown in FIG. 3. According to the current embodiment of the present invention, the common voltage $V_{comDC}$ may have a voltage level between those of the storage common high voltage $V_{stcom}H$ and the storage common low voltage $V_{stcom}L$.

The backlight unit 160 is turned off during the programming sections T1, and turned on during the light emitting sections T2. To this end, as shown in FIG. 3, the backlight driving signal is configured to have a voltage level that turns the backlight unit 160 on during the light emitting sections T2.

FIG. 4 is a timing diagram showing times of the driving signals within one sub-frame, according to an embodiment of the present invention.

One sub-frame SUB_FRAME is initialized by the vertical synchronization signal Vsync. During the programming section T1, scan pulses with respect to each of the rows are sequentially generated by the vertical synchronization signal Vsync. When the scan pulses are sequentially generated, the data voltage is input to each of the pixels 152, and thus, the data voltage is written in the storage capacitor $C_{stg}$. Here, the first storage common voltages $V_{stcom_odd}$ of the pixels 152 in the first group have the voltage level of the storage common high voltage $V_{stcom}H$, and the data voltage, which is applied to the pixels 152 of the first group, is biased to a lower level. On the other hand, the second storage common voltages $V_{stcom_even}$ of the pixels 152 in the second group have the voltage level of the storage common low voltage $V_{stcom}L$, and the data voltage, which is applied to the pixels 152 of the second group, is biased to a higher level. In the next sub-frame, the first storage common voltage $V_{stom_odd}$ has the voltage level of the storage common low voltage $V_{stcom}L$ and the second storage common voltage $V_{stcom_even}$ has the voltage level of the storage common high voltage $V_{stcom}H$. Accordingly, the data voltage, which is biased to a higher level, is applied to the pixels 152 of the first group, and the data voltage, which is biased to a lower level, is applied to the pixels 152 of the second group. Herein, the voltage biased to a higher level is referred to as a positively biased voltage, and the data voltage biased to a lower level is referred to as a negatively biased voltage.

When the writing of the data voltage in each of the pixels 152 is completed, the backlight driving signal BLC is activated during the light emitting section T2 so that the backlight unit 160 is turned on. In addition, in the light emitting section T2, voltage levels of the first and second storage common voltages $V_{stcom_odd}$ and $V_{stcom_even}$ are transited so that the voltage at the first node N1 that is connected to the storage capacitor $C_{stg}$ is boosted by the first or second storage common voltages $V_{stcom_odd}$ or $V_{stcom_even}$. The orientation direction of the liquid crystal layer in the liquid crystal capacitor $Cl_c$ is determined according to the boosted voltage at the first node N1, and the light transmittance of the liquid crystal layer is adjusted.

Figure 5:
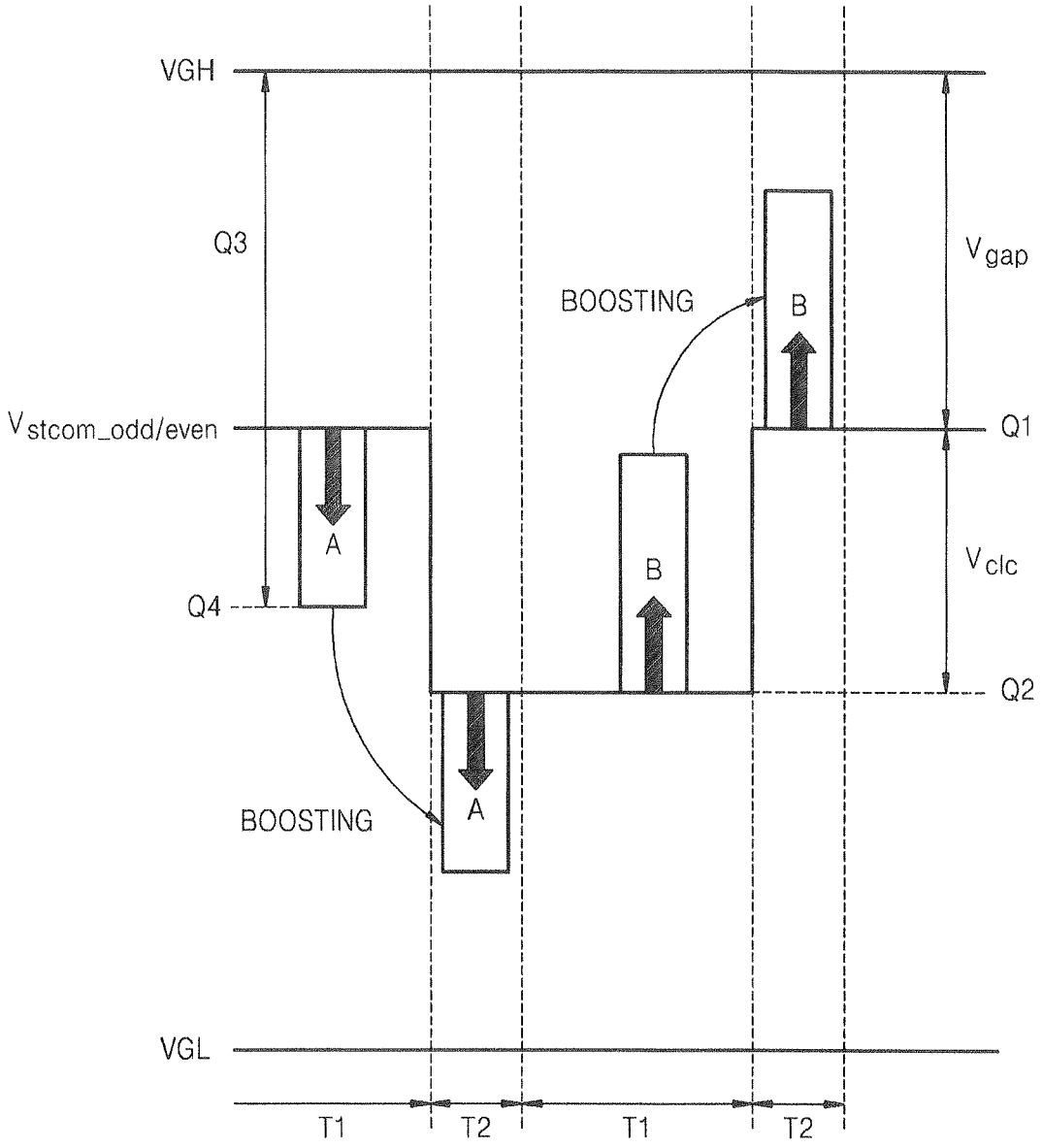
FIG. 5 is a diagram illustrating processes of writing data and boosting in a liquid crystal display apparatus, according to an embodiment of the present invention.

FIG. 5 is a diagram showing processes of writing and boosting the data voltage, according to an embodiment of the present invention. In FIG. 5, voltage levels Q1 is the storage common high voltage $V_{stcom}H$, Q2 is the storage common low voltage $V_{stcom}L$, and Q4 is a level of the data voltage. The voltage Q3 is a voltage $V_{gs}$ applied between the gate and source of the switching device M1.

As shown in FIG. 5, when the storage common voltage $V_{stcom}$ has the voltage level of the storage common high voltage $V_{stcom}H$, the negatively biased data voltage is written in the storage capacitor $C_{stg}$ during the programming section T1 (marked by A), and the voltage at the first node N1 is boosted in the negative direction in the light emitting section T2 with respect to the storage common high voltage $V_{stcom}H$. In other words, the voltage at the first node N1, in this case, is boosted by the storage common voltage $V_{stcom}$. In the next sub-frame, since the storage common voltage $V_{stcom}$ has the voltage level of the storage common low voltage $V_{stcom}L$, the positive data voltage is written in the storage capacitor $C_{stg}$ during the programming section T1 (marked by B), and the voltage at the first node N1 is boosted in the positive direction during the light emitting section T2 with respect to the storage common low voltage $V_{stcom}L$. In other words, the voltage at the first node N1, in this case, is boosted by the storage common voltage $V_{stcom}$. According to the current embodiment, the data voltage applied to the first node N1 has the voltage level between those of the storage common low voltage $V_{stcom}L$ and the storage common high voltage $V_{stcom}H$, and thus, $V_{gs}$ of the switching device M1, which is formed of the TFT, may be equal to or greater than $V_{gap}$. Herein, the $V_{gs}$ of the switching device M1 is the voltage applied between the gate and source of the switching device M1. According to the current embodiment, since the storage common voltage $V_{stcom}$, is swung, $V_{gap}$ may be maintained to be relatively large, as compared to a case where the storage common voltage $V_{stcom}$ is maintained constant. In addition, each of the pixels 152 is not independently driven. The storage common voltage $V_{stcom}$ of the pixels 152 in the first group is commonly driven, and the storage common voltage $V_{stcom}$ of the pixels 152 in the second group is commonly driven, and thus, the driving of the storage common voltage $V_{stcom}$ is performed in a simpler way. Therefore, according to the embodiment of the present invention, Vgap may be maintained to be large with a simple driving, and thus, Vgs is increased. Since Vgs is increased, the programming section T1 for writing the data voltage in the pixels 152 may be reduced, and accordingly, the light emitting section T2 may be increased and the brightness of the liquid crystal display apparatus 100 may be greatly improved.

Figure 6:
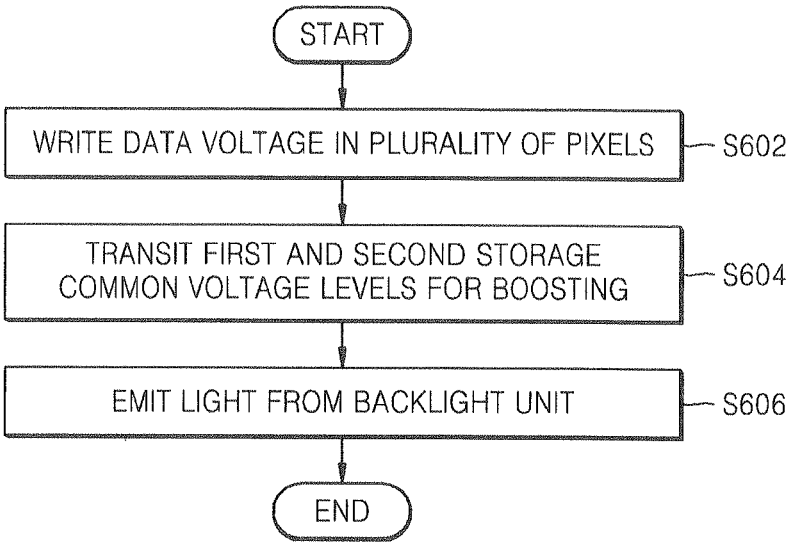
FIG. 6 is a flowchart illustrating a method of driving the liquid crystal display apparatus of FIG. 1, according to an embodiment of the present invention.

FIG. 6 is a flowchart illustrating a method of driving the liquid crystal display apparatus 100 of FIG. 1, according to an embodiment of the present invention.

The data driving unit 120 writes the data voltage in the pixels 152 (S602). At this time, the first storage common voltage $V_{stcom_odd}$ is applied to the storage capacitors $C_{stg}$ of the pixels 152 in the first group, and the second storage common voltage $V_{stcom_even}$ is applied to the storage capacitors $C_{stg}$ of the pixels 152 in the second group. In addition, during writing the data voltage to the pixels 152 of the first and second groups, the backlight unit 160 is in the turn-off state.

When the data voltage is written in all of the pixels 152, the storage common voltage driving unit 140 transits the first and second storage common voltage levels in order to boost the voltage levels of the pixels 152 in the first group and the pixels 152 in the second group to different polarities (S604). For example, when the first storage common voltage has the voltage level of the storage common high voltage $V_{stcom}H$ and the second storage common voltage has the voltage level of the storage common low voltage $V_{stcom}L$ during writing of the data voltage, the voltage level of the first storage common voltage is transited to the voltage level of the storage common low voltage $V_{stcom}L$ and the voltage level of the second storage common voltage is transited to the voltage level of the storage common high voltage $V_{stcom}H$ during the boosting operation, and accordingly, the pixels 152 of the first group are boosted in the negative direction and the pixels 152 of the second group are boosted in the positive direction.

When the transition of the voltage levels of the first and second storage common voltages is completed, the backlight unit 160 emits the light. Therefore, the liquid crystal display apparatus 100 displays an image.

Figure 7:
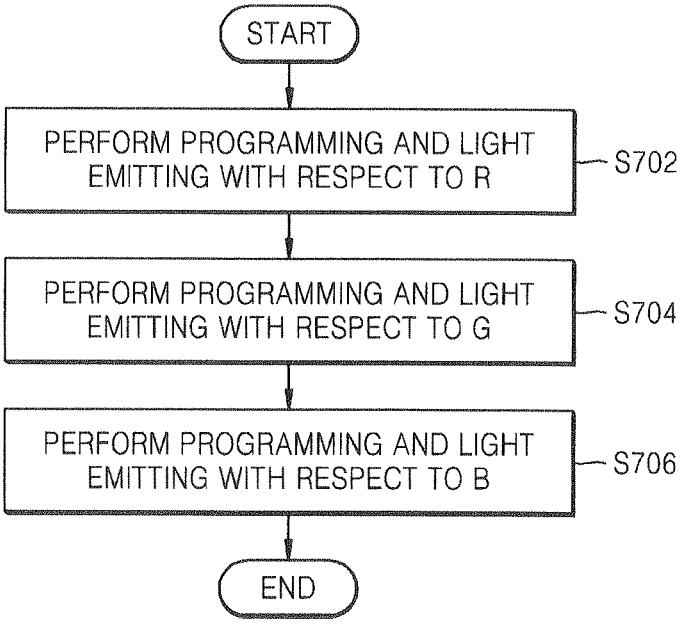
FIG. 7 is a flowchart illustrating a time-divisional driving method of a liquid crystal display apparatus, according to an embodiment of the present invention.

FIG. 7 is a flowchart illustrating a time-divisional driving method of the liquid crystal display apparatus 100, according to an embodiment of the present invention.

According to the current embodiment, the display of R, G, and B images is performed in the time-divisional way. For example, programming and light emission with respect to R pixels are performed (S702), programming and light emission with respect to G pixels are performed (S704), and programming and light emission with respect to B pixels are performed (S706). The above order is an example of the time-divisional way, and the driving order of the R, G, and B may vary according to embodiments.

According to the embodiments of the present invention, the charging speed of each of the pixels may be increased, and the brightness of the liquid crystal display apparatus is improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display apparatus comprising:

a first group of pixels for displaying an image;

a second group of pixels for displaying an image, each pixel of the first and second groups being disposed on a portion where one of data lines and one of gate lines cross each other, each pixel of the first and second groups including a storage capacitor for storing a data voltage;

a gate driving unit for outputting scan pulses to the pixels of the first and second groups through the gate lines;

a data driving unit for generating the data voltage corresponding to an input image data signal and outputting the data voltage to each pixel of the first and second groups through the data lines;

a first storage common voltage line connected to the storage capacitors of the pixels of the first group of pixels;

a second storage common voltage line connected to the storage capacitors of the pixels of the second group of pixels; and a storage common voltage driving unit for generating a first storage common voltage and outputting the first storage common voltage to the pixels of the first group through the first storage common voltage line, the storage common voltage driving unit generating a second storage common voltage and outputting the second storage common voltage to the pixels of the second group through the second storage common voltage line, wherein in a first programming section during which data voltage is stored in the storage capacitors of the pixels of the first and second groups, the first storage common voltage has a storage common high voltage level and the second storage common voltage has a storage common low voltage level, and in a first light emitting section during which the voltage stored in the storage capacitors of the pixels of the first and second groups is transited to pixel electrodes of the pixels of the first and second groups, the first storage common voltage has the storage common low voltage level and the second storage common voltage has the storage common high level.

2. The liquid crystal display apparatus of claim 1, further comprising a backlight unit for emitting light to the pixels of the first and second groups.

3. The liquid crystal display apparatus of claim 2, wherein the backlight unit emits light during the first light emitting section, the first light emitting section sequentially following the first programming section.

4. The liquid crystal display apparatus of claim 3, wherein in a second programming section, the first storage common voltage has the storage common low voltage level and the second storage common voltage has the storage common high level, and in a second light emitting section, the first storage common voltage has the storage common high voltage level and the second storage common voltage has the storage common low voltage level, the backlight unit emitting light during the second light emitting section, the data voltage being stored in the storage capacitor of the each pixel of the first and second groups during the second programming section, the second light emitting section sequentially following the second programming section.

5. The liquid crystal display apparatus of claim 4, wherein the second programming section sequentially follows the first light emitting section.

6. The liquid crystal display apparatus of claim 4, wherein the backlight unit does not emit light during the first and second programming section.

7. The liquid crystal display apparatus of claim 4, wherein the data driving unit writes the data voltage in the pixels of the first group in a negative direction from the storage common high voltage level during the first programming section, and writes the data voltage in the pixels of the second group in a positive direction from the storage common low voltage level during the first programming section; and the data driving unit writes the data voltage in the pixels of the first group in the positive direction from the storage common low voltage level during the second programming section, and writes the data voltage in the pixels of the second group in the negative direction from the storage common high voltage level during the second programming section.

8. The liquid crystal display apparatus of claim 1, wherein the data driving unit supplies the data voltage so as to have a red (R) sub-frame section in which the data voltage with respect to R is generated and output, a green (G) sub-frame section in which the data voltage with respect to G is generated and output, and a blue (B) sub-frame section in which the data voltage with respect to B is generated and output, in a time-divisional method.

9. The liquid crystal display apparatus of claim 1, wherein the pixels of the first group are located on odd-numbered lines, and the pixels of the second group are located on even-numbered lines.

10. A method of driving a liquid crystal display apparatus, which comprises a first group of pixels for displaying an image and a second group of pixels for displaying an image, a first storage common voltage line connected to storage capacitors of the pixels of the first group of pixels, and a second storage common voltage line connected to storage capacitors of the pixels of the second group of pixels, the method comprising:

writing a data voltage in the pixels of the first and second groups;

supplying a first storage common voltage to the pixels of the first group through the first storage common voltage line;

supplying a second storage common voltage to the pixels of the second group through the second storage common voltage line;

transiting the voltage levels of the first and second storage common voltages; and emitting light from a backlight unit included in the liquid crystal display apparatus, wherein in a first programming section during which data voltage is stored in the storage capacitors of the pixels of the first and second groups, the first storage common voltage has a storage common high voltage level and the second storage common voltage has a storage common low voltage level, and in a first light emitting section during which the voltage stored in the storage capacitors of the pixels of the first and second groups is transited to pixel electrodes of the pixels of the first and second groups, the first storage common voltage has the storage common low voltage level and the second storage common voltage has the storage common high level.

11. The method of claim 10, further comprising:

performing programming, transiting, and light emitting for R pixels;

performing programming, transiting, and light emitting for G pixels; and performing programming, transiting, and light emitting for B pixels.

12. The method of claim 10, wherein the backlight unit emits light during the first light emitting section, the first light emitting section sequentially following the first programming section.

13. The method of claim 12, wherein in a second programming section, the first storage common voltage has the storage common low voltage level and the second storage common voltage has the storage common high level, and in a second light emitting section, the first storage common voltage has the storage common high voltage level and the second storage common voltage has the storage common low voltage level, the backlight unit emitting light during the second light emitting section, the data voltage being stored in the storage capacitor of the each pixel of the first and second groups during the second programming section, the second light emitting section sequentially following the second programming section.

14. The method of claim 13, further comprising:

writing the data voltage in the pixels of the first group in a negative direction from the storage common high voltage level during the first programming section;

writing the data voltage in the pixels of the second group in a positive direction from the storage common low voltage level during the first programming section;

writing the data voltage in the pixels of the first group in the positive direction from the storage common low voltage level during the second programming section; and writing the data voltage in the pixels of the second group in the negative direction from the storage common high voltage level during the second programming section.

15. The liquid crystal display apparatus of claim 13, wherein the second programming section sequentially follows the first light emitting section.

16. The method of claim 10, wherein the pixels of the first group are located on odd-numbered lines, and the pixels of the second group are located on even-numbered lines.

* * * * *